US006846203B1

(12) United States Patent
Su

(10) Patent No.: US 6,846,203 B1
(45) Date of Patent: Jan. 25, 2005

(54) MOISTURE PROOF PLUG BLADE

(75) Inventor: Tun-Li Su, Kaohsiung Hsien (TW)

(73) Assignee: Gem Terminal Ind. Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/653,985

(22) Filed: Sep. 4, 2003

(51) Int. Cl.[7] ..... H01R 13/04
(52) U.S. Cl. ..... 439/693
(58) Field of Search ..... 439/693, 607, 439/736

(56) References Cited

U.S. PATENT DOCUMENTS 3,199,967 A * 8/1965 Pixley ..... 65/50
5,133,746 A * 7/1992 Brady et al. ..... 623/6.46
5,641,311 A * 6/1997 Chuang ..... 439/693
6,527,596 B1 * 3/2003 Su ..... 439/693

* cited by examiner

*Primary Examiner*—Phuong Dinh
(74) *Attorney, Agent, or Firm*—Rosenberg, Klein & Lee

(57) ABSTRACT

A plug blade includes a front section and a rear section. The rear section has a through-hole extending from a first face of the rear section through a second face of the rear section opposite to the first face. An insulating laying is formed on the rear section by injection molding and fills the though-hole of the rear section of the plug blade. The insulating layer includes a flange that abuts against an inner face of an inner frame during a procedure for forming a housing of a plug, thereby preventing moisture from entering an interior of the housing of the plug.

1 Claim, 18 Drawing Sheets

MOISTURE PROOF PLUG BLADE

BACKGROUND OF THE INVENTION

1. Field of the Invention

The present invention relates to a plug blade. In particular, the present invention relates to a moisture proof blade for preventing moisture from entering an interior of a plug 2. Description of the Related Art A plug is a necessary element to all industries and other fields. The plug is engaged with a socket to supply electricity to an electric appliance or other electric equipments that may be used in many places including a humid environment. Thus, there is a risk of short circuit, as moisture may enter a gap between an outer periphery of a respective plug blade and a peripheral wall delimiting a respective slot of a socket into which the plug blade is inserted.

FIGS. 1 and 2 illustrate a conventional plug blade 1 having a protective sleeve 2 mounted thereon. The protective sleeve 2 includes a through-hole 21 that is rectangular in section and to which the plug blade 1 extends. However, additional cost is incurred for a mold for producing the protective sleeve 2. Further, the protective sleeve 2 and the plug blade 1 are separate members such that entrance of moisture via the gap between the protective sleeve 2 and the plug blade 1 is still possible. Further, the bonding force between the between sleeve 2 and the plug blade 1 is insufficient such that the protective sleeve 2 may disengage from the plug blade 1 during a subsequent procedure of coupling a wire to the plug blade 1.

SUMMARY OF THE INVENTION

An object of the present invention is to provide a moisture proof blade for preventing moisture from entering an interior of a plug, avoiding potential short circuit and damage.

Another object of the present invention is to provide a moisture proof blade including an insulating layer firmly bonded thereto.

A plug blade in accordance with the present invention includes a front section and a rear section. The rear section has a through-hole extending from a first face of the rear section through a second face of the rear section opposite to the first face. An insulating laying is formed on the rear section by injection molding and fills the through-hole of the rear section of the plug blade. The insulating layer includes a flange that abuts against an inner face of an inner frame during a procedure for forming a housing of a plug, thereby preventing moisture from entering an interior of the housing of the plug.

Other objects advantages, and novel features of the invention will become more apparent from the following detailed description when taken in conjunction with the accompanying drawings.

DETAILED DESCRIPTION OF THE PREFERRED EMBODIMENTS

Figure 2:
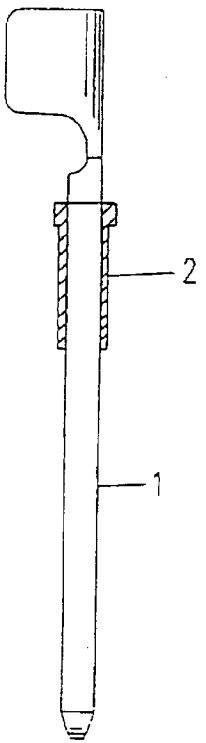
FIG. 2 PRIOR ART
FIG. 2 is a sectional view of the conventional plug blade.
Figure 1:
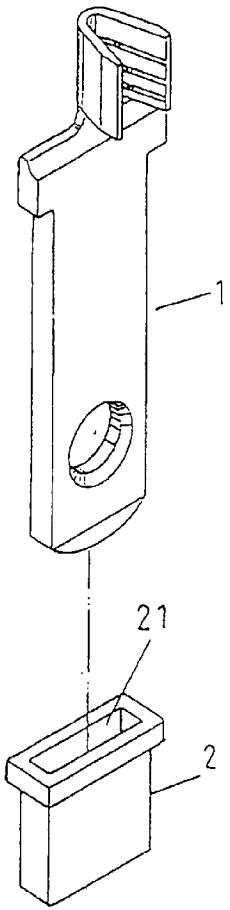
FIG. 1 PRIOR ART
FIG. 1 is an exploded perspective view of a conventional plug blade.
Figure 3:
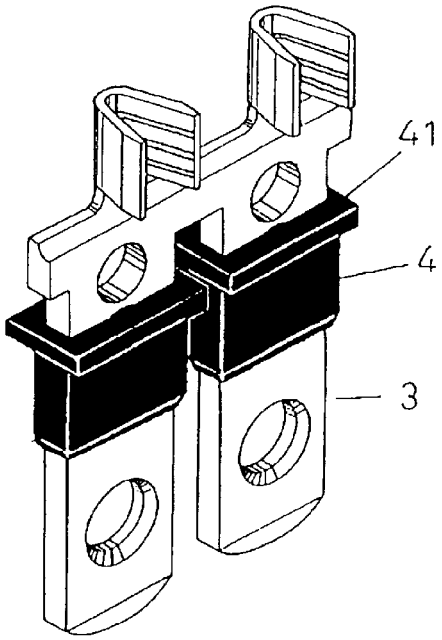
FIG. 3 is a perspective view of a row of plug blades in accordance with a first embodiment of the present invention.
Figure 4:
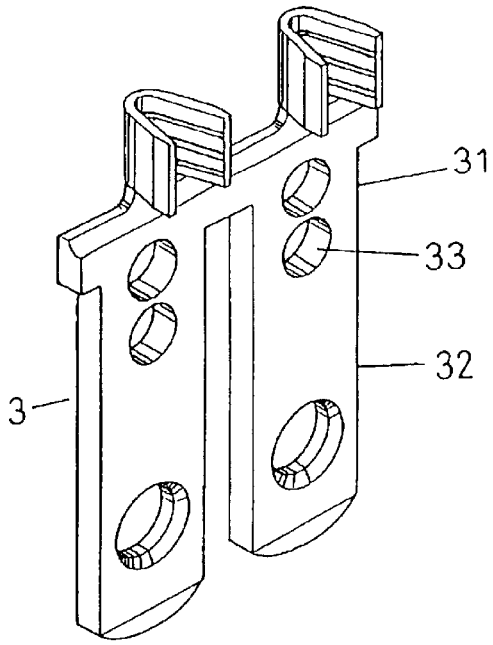
FIG. 4 is a perspective view of the row of plug blades in FIG. 3, wherein an insulating layer on the respective plug blade is removed to show structure of the respective plug.

Referring to FIGS. 3, 4, 9, and 10, a plug blade 3 in accordance with the present invention is cut from a row of plug blades 3 in FIG. 3 and includes an enclosed rear section 31 enclosed by an insulating layer 4 and an exposed front section 32. The enclosed rear section 31 includes a through-hole 33 extending from a first face of the rear section 31 through a second face of the rear section 31 opposite to the first face. The plug blade 3 is made of metal for conducting electricity.

The insulating layer 4 is made of plastics and formed on the rear section 31 by injection molding, as shown in FIG. 3. The insulating layer 4 may include a flange 41 on a rear end thereof. Molten plastic material is poured into a mold (not shown) in which the respective plug blade 3 is placed. The molten plastic material also fills the through-hole 33 of the respective plug blade 3. Thus, after hardening of the molten plastic material, the insulating layer 4 is firmly bonded with the rear section 31 of the respective plug blade 3, best shown in FIGS. 9 and 10. The flange 41 of the insulating layer 4 abuts against an inner face of an inner frame 5 (FIG. 13) during subsequent formation of a housing 6 (FIG. 14) and the flange 41 that provides a final product of the plug. Thus, entrance of moisture into an interior of the housing 6 of the plug is prevented.

Figure 28:
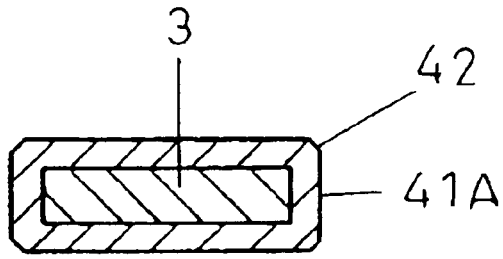
FIG. 28 is a cross sectional illustrating a modified embodiment of the insulating layer of the plug blade in accordance with the present invention.
Figure 29:
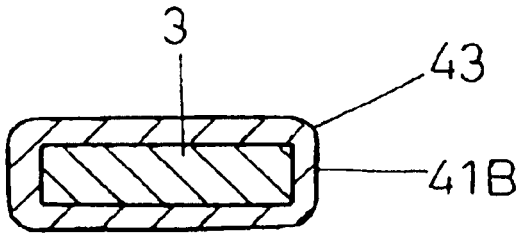
FIG. 29 is a cross sectional view similar to FIG. 28, illustrating another modified embodiment of the insulating layer of the plug blade in accordance with the present invention.

As illustrated in FIG. 28, the flange (now designated by 41A) may include chamfered corners 42. As illustrated in FIG. 29, the flange (now designated by 41B) may include rounded corners 43.

Figure 14:
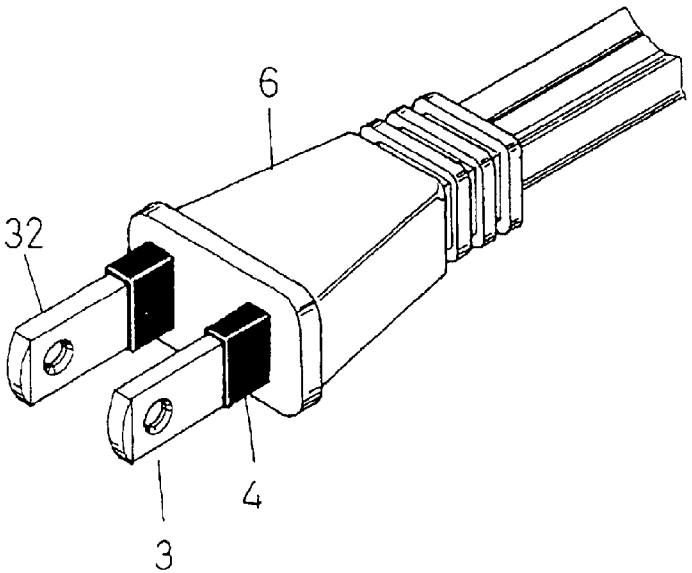
FIG. 14 is a perspective view of a plug made from semi-product of the plug in FIG. 13.
Figure 13:
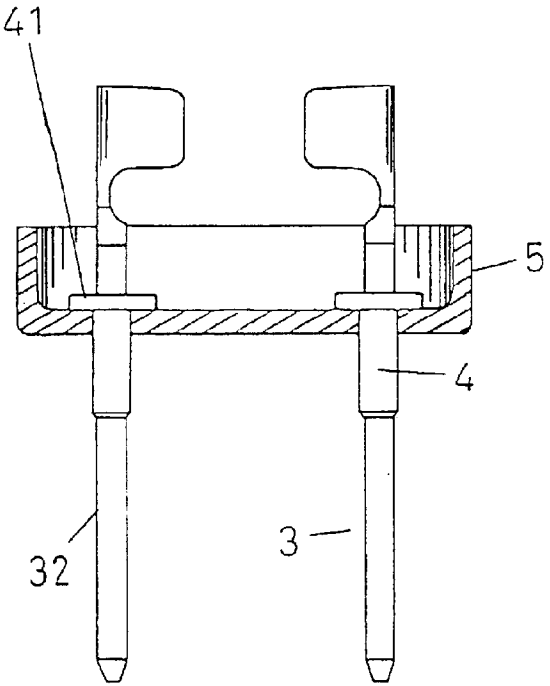
FIG. 13 is a sectional view of a semi-product of a plug made from the plug blade in FIG. 3.

Referring to FIGS. 13 and 14, an layer 4 is firstly formed on the respective plug blade 3. After coupling an end of a wire (not shown) to the respective plug blade 3, the respective plug blade 3 is mounted on and thus positioned by an inner frame 5 for subsequent formation of a housing 6 by means of injection molding. Thus, a plug with two plug blades 3 is provided.

Figure 19:
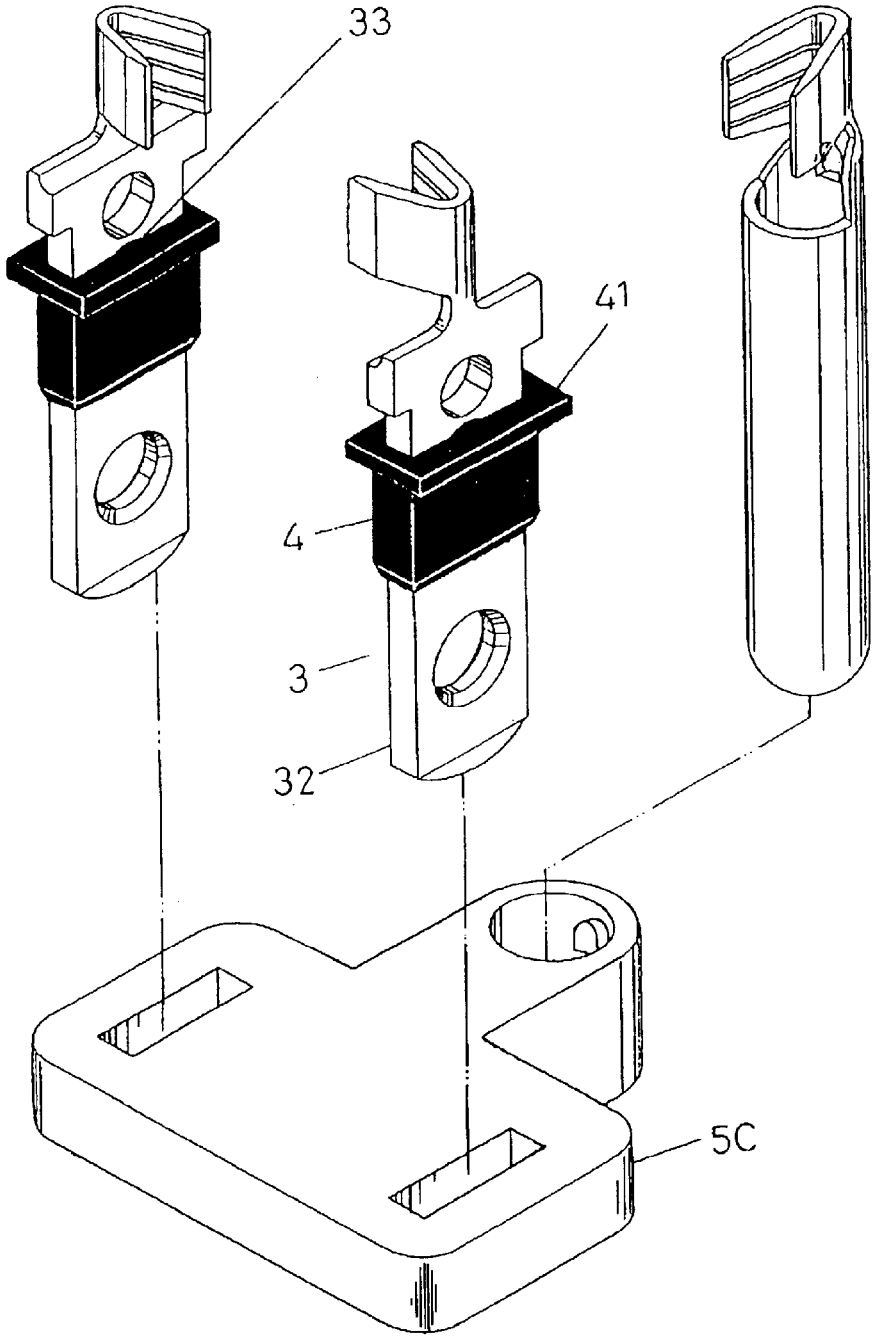
FIG. 19 is an exploded perspective view of a semi-product of another plug made from the plug blade in FIG. 3.
Figure 21:
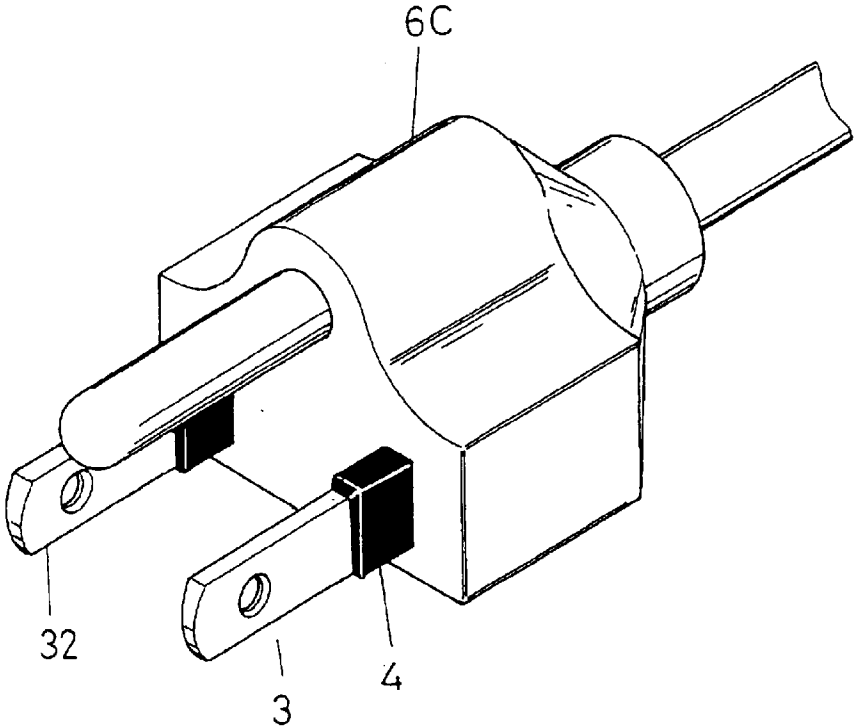
FIG. 21 is a perspective view of a plug made from semi-product of another plug in FIG. 20.
Figure 20:
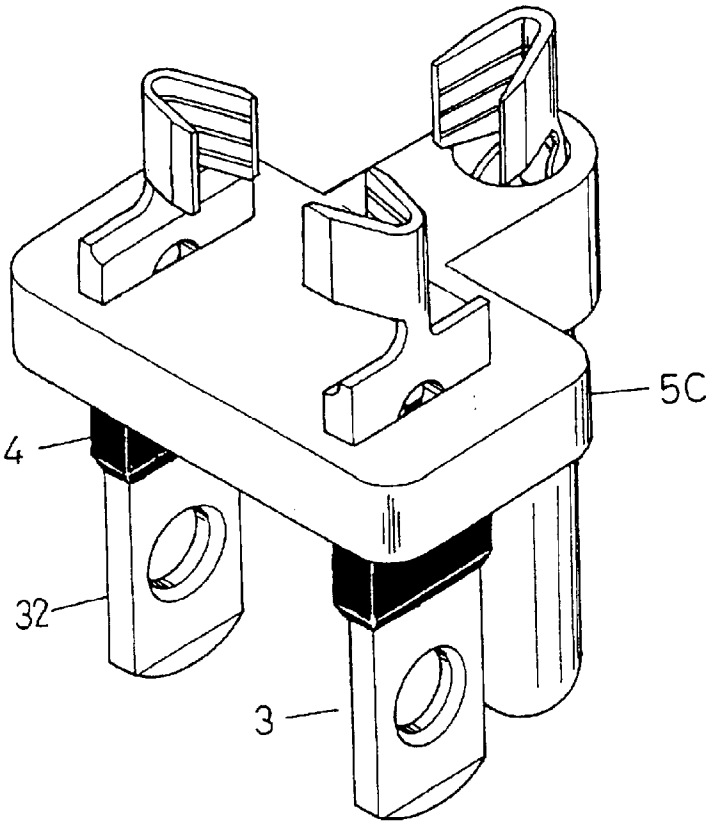
FIG. 20 is a perspective view of the semi-product of another plug in FIG. 19.

FIG. 19 is an exploded perspective view of a semi-product of another plug made from the plug blade in FIG. 3. FIG. 20 is a perspective view of the semi-product of another plug in FIG. 19. FIG. 21 is a perspective view of a plug made from semi-product of another plug in FIG. 20. An insulating layer 4 is firstly formed on the respective plug blade 3. After coupling an end of a wire (not shown) to the respective plug blade 3, the respective plug blade 3 is mounted on and thus positioned by an inner frame 5C for subsequent formation of a housing 6C by means of injection molding. Thus, a plug with three plug blades 3 is provided.

Figure 5:
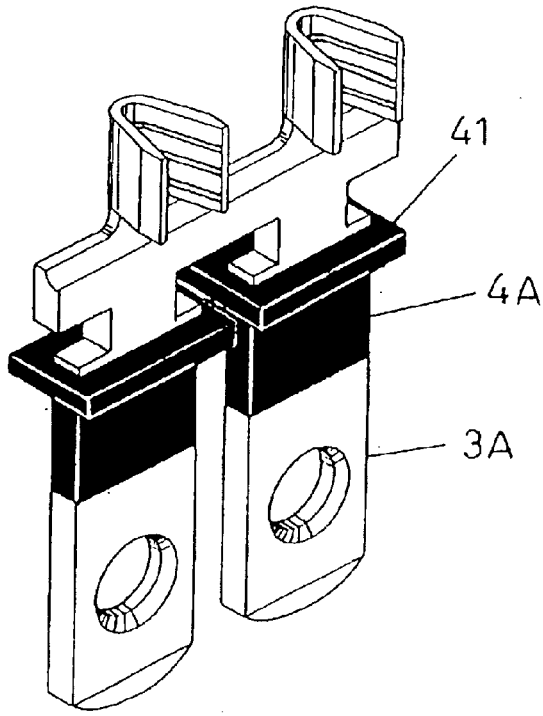
FIG. 5 is a perspective view of a row of plug blades in accordance with a second embodiment of the present invention.
Figure 6:
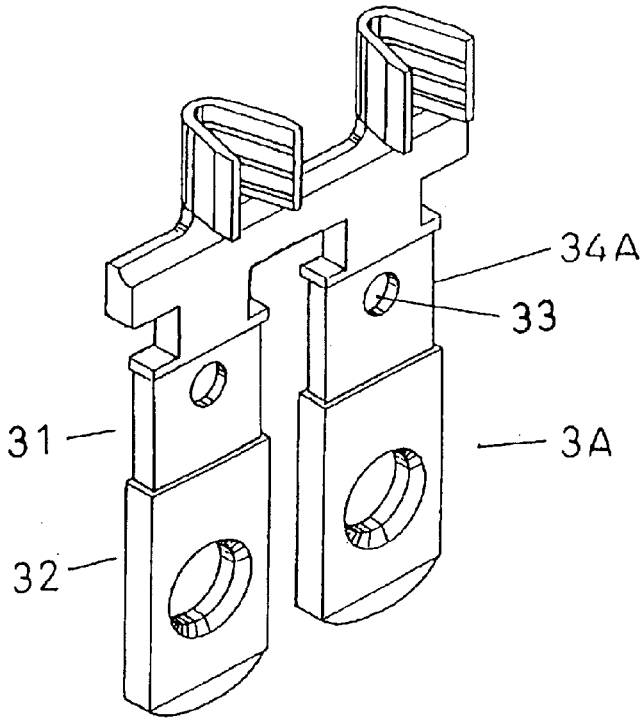
FIG. 6 is a perspective view of the row of plug blades in FIG. 5, wherein an insulating layer on the respective plug blade is removed to show structure of the respective plug.
Figure 11:
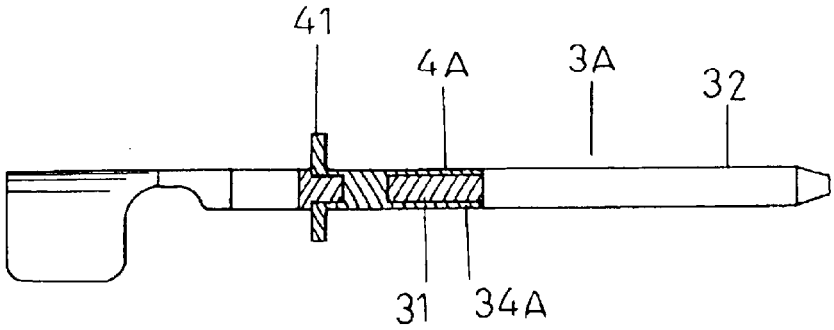
FIG. 11 is a side view, partly sectioned, of the plug blades in FIG. 5.
Figure 12:
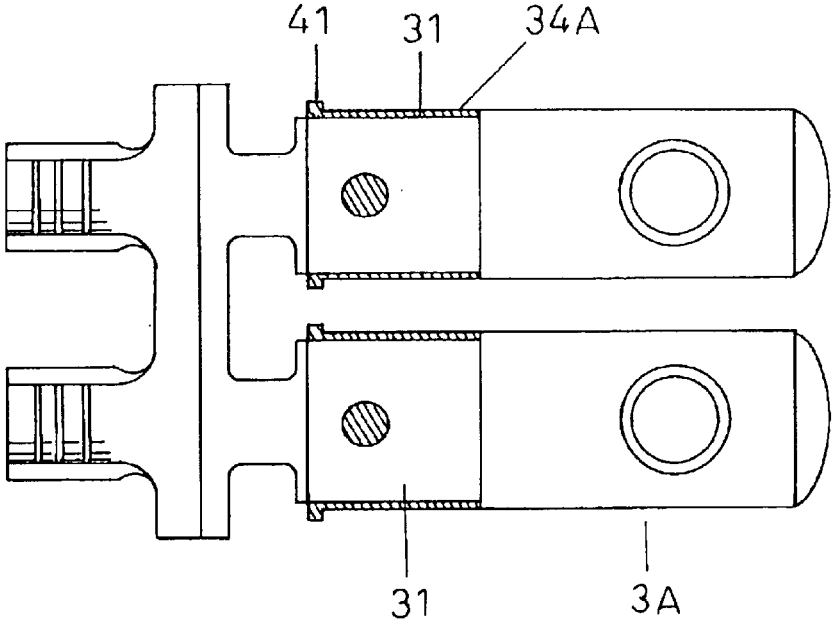
FIG. 12 is a sectional view of the plug blades in FIG. 5.

FIGS. 5 and 6 illustrates a row of plug blades 3A of another type. FIG. 11 is a side view, partly sectioned, of the plug blades in FIG. 5. FIG. 12 is a sectional view of the plug blades in FIG. 5. In this embodiment, the plug blade 3A includes a front section 32 and a rear section 31 having a through-hole 33 extending from a first face of the rear section 31 through a second face of the rear section 31 opposite to the first face. An insulating layer 4A having a flange 41 encloses the rear section 31 and fills the through-hole 33, as mentioned above. Four faces 34A of the rear section 31 are lower than those of the front section 32. After formation, four faces of the insulating layer 4A (except the flange 41) are respectively flush with those of the front section 32.

Figure 18:
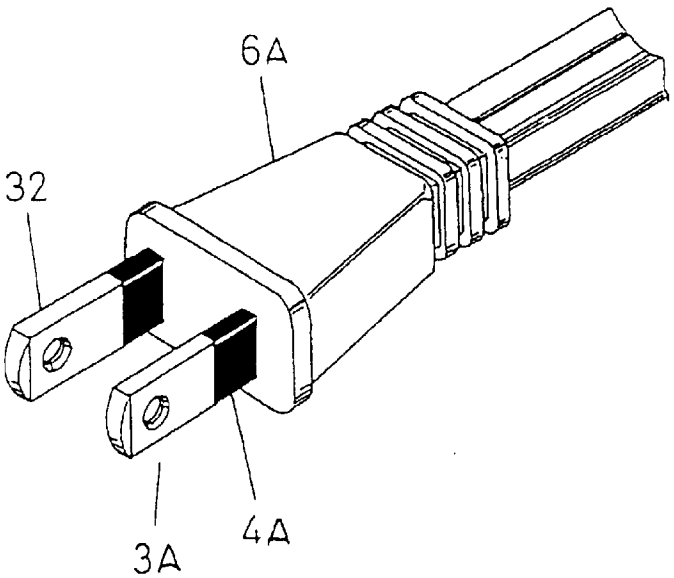
FIG. 18 is a perspective view of a plug made from semi-product of the plug in FIG. 17.
Figure 17:
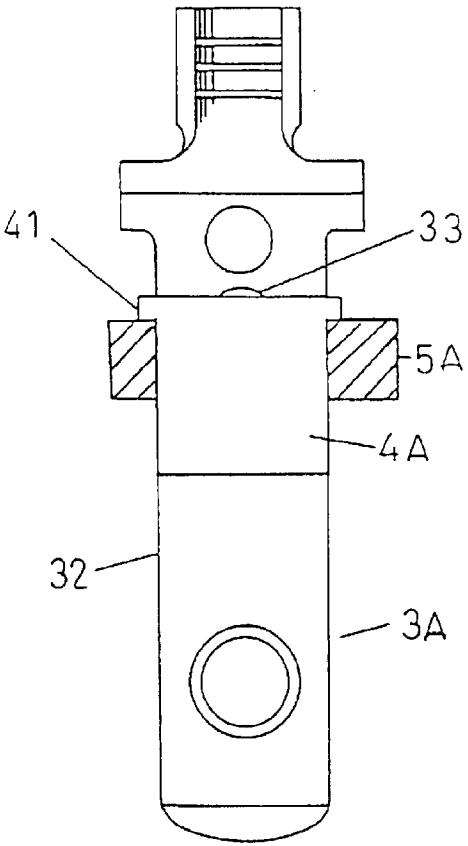
FIG. 17 is a sectional view of a semi-product of a plug made from the plug blade in FIG. 5

Referring to FIGS. 17 and 18, an insulting layer 4A is firstly formed on the respective plug blade 3A. After coupling an end of a wire (not shown) to the respective plug blade 3A, the respective plug blade 3A is mounted on and thus positioned by an inner frame 5A for subsequent formation of a housing 6A by means of injection molding. Thus, a plug with two plug blades 3A is provided.

Figure 25:
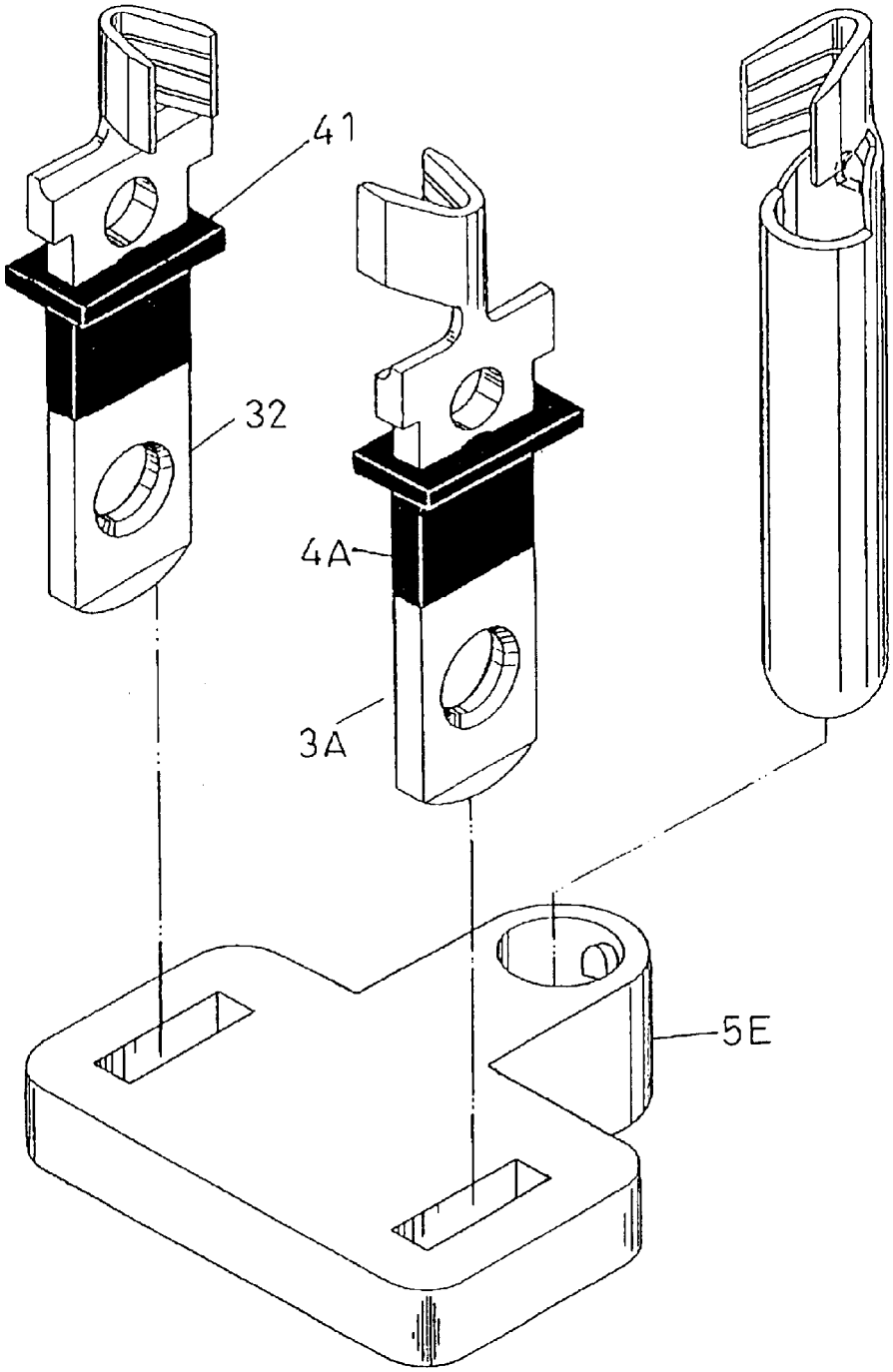
FIG. 25 is an exploded perspective view of a semi-product of another plug made from the plug blade in FIG. 5.
Figure 27:
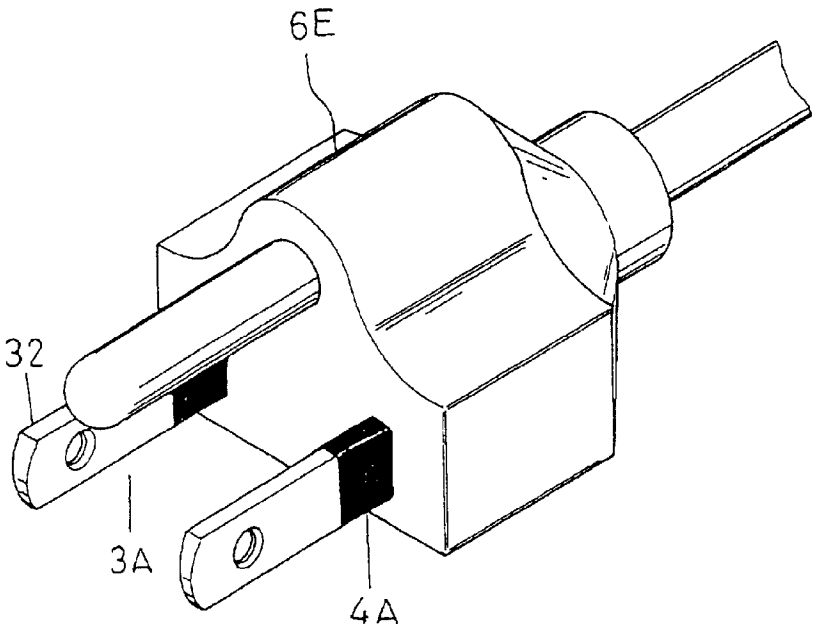
FIG. 27 is a perspective view of a plug made from semi-product of another plug in FIG. 26.
Figure 26:
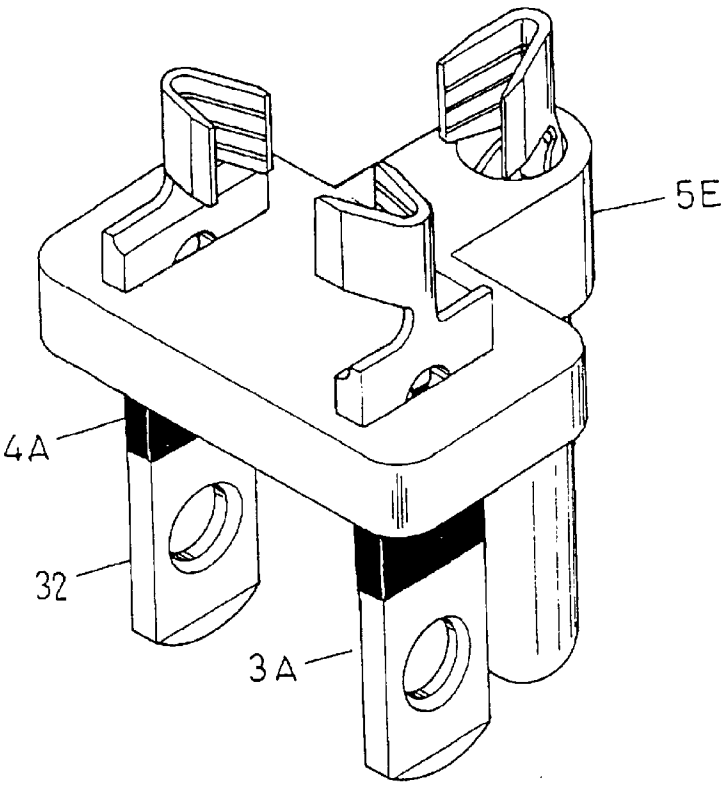
FIG. 26 is a perspective view of the semi-product of another plug in FIG. 25.

FIG. 25 is an exploded perspective view of a semi-product of another plug made from the plug blade in FIG. 5. FIG. 26 is a perspective view of the semi-product of another plug in FIG. 25. FIG. 27 is a perspective view of a plug made from semi-product of another plug in FIG. 26. An insulating layer 4A is firstly formed on the respective plug blade 3A. After coupling an end of a wire (not shown) to the respective plug blade 3A, the respective plug blade 3A is mounted on and thus posit by an inner frame 5E for subsequent formation of a housing 6E by means of injection molding. Thus, a plug with tee plug blades 3A is provided.

Figure 7:
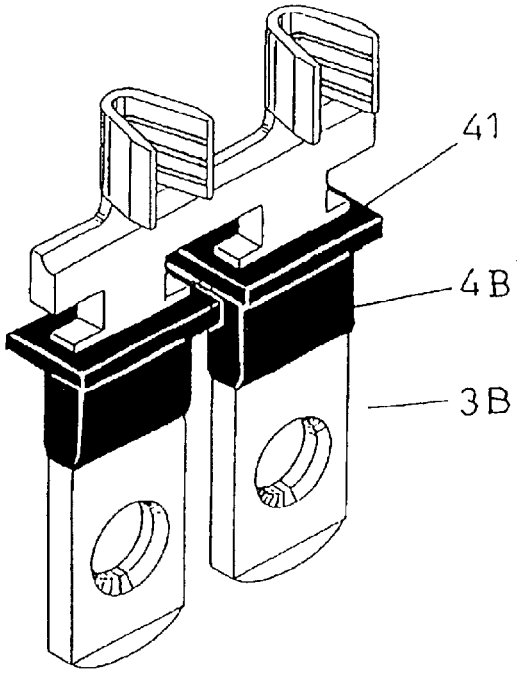
FIG. 7 is a perspective of a row of plug blades in accordance with a third embodiment of the present invention
Figure 8:
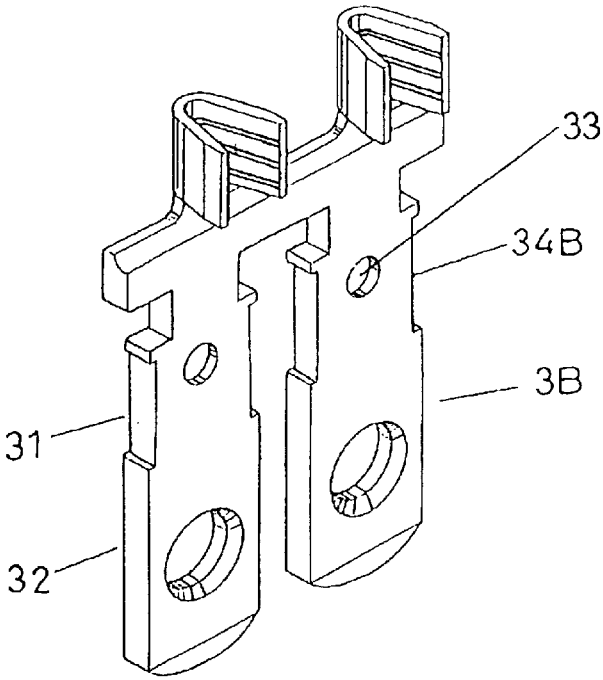
FIG. 8 is a perspective view of the row of plug blades in FIG. 7, wherein an insulating layer on the respective plug blade is removed to show structure of the respective plug
Figure 9:
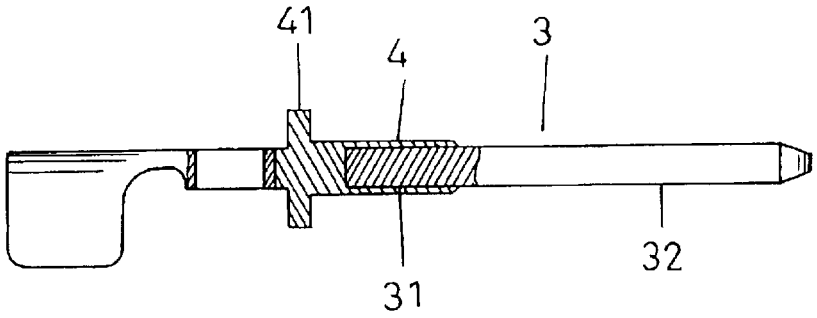
FIG. 9 is a side view, partly sectioned, of the plug blades in FIG. 3.
Figure 10:
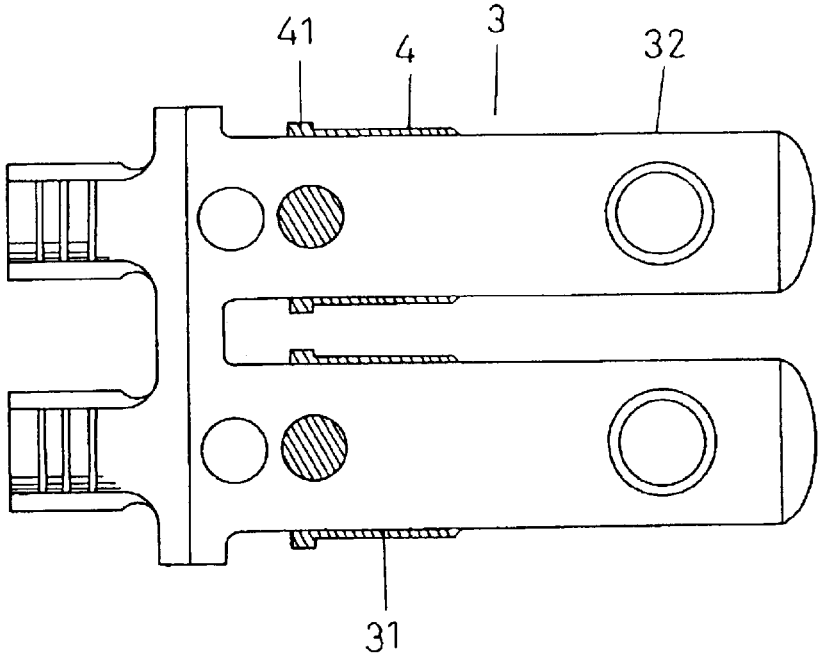
FIG. 10 is a sectional view of the plug blades in FIG. 3.

FIGS. 7 and 8 illustrate a mw of plug blades 3B of another type. In this embodiment, the plug blade 3B includes a front section 32 and a rear section 31 having a through-hole 33 extending from a first face of the rear section 31 through a second face of the rear section 31 opposite to the first face. An insulating layer 4B having a flange 41 encloses the rear section 31 and fills the through-hole 33, as mentioned above. Two lateral faces 34B of the rear section 31 are lower than those of the front section 32. After formation, two lateral of the insulting layer 4A (except the flange 41) are respectively flush with those of the front section 32.

Figure 16:
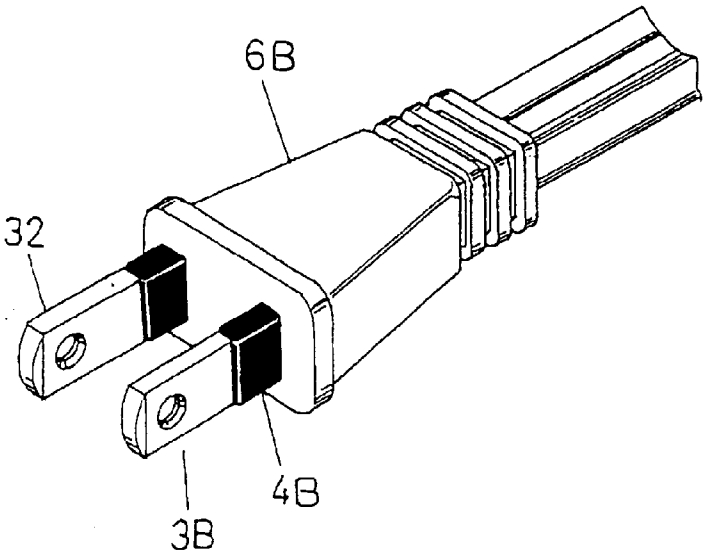
FIG. 16 is a perspective view of a plug made from semi-product of the plug in FIG. 15.
Figure 15:
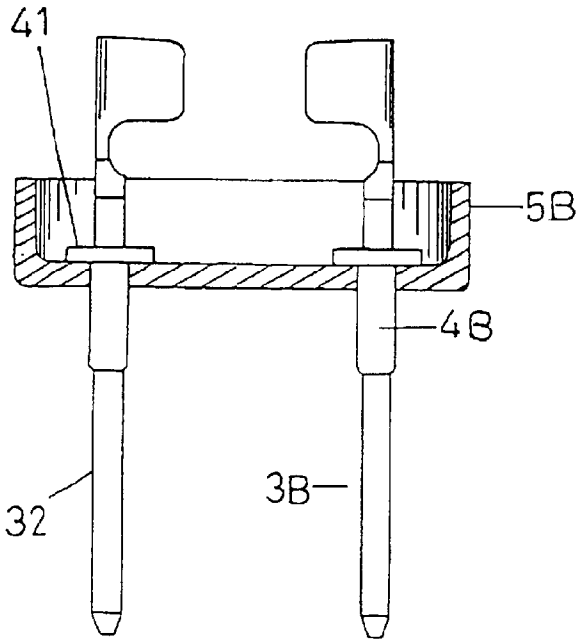
FIG. 15 is a sectional view of a semi-product of a plug made from the plug blade in FIG, 7.

Referring to FIGS. 15 and 16, an insulating layer 4B is fly formed on the respective plug blade 3B. After coupling an end of a wire (not shown) to the respective plug blade 3B, the respective plug blade 3B is mounted on and thus positioned by an inner frame 5B for subsequent formation of a housing 6B by means of injection molding. Thus, a plug with two plug blades 3B is provided.

Figure 22:
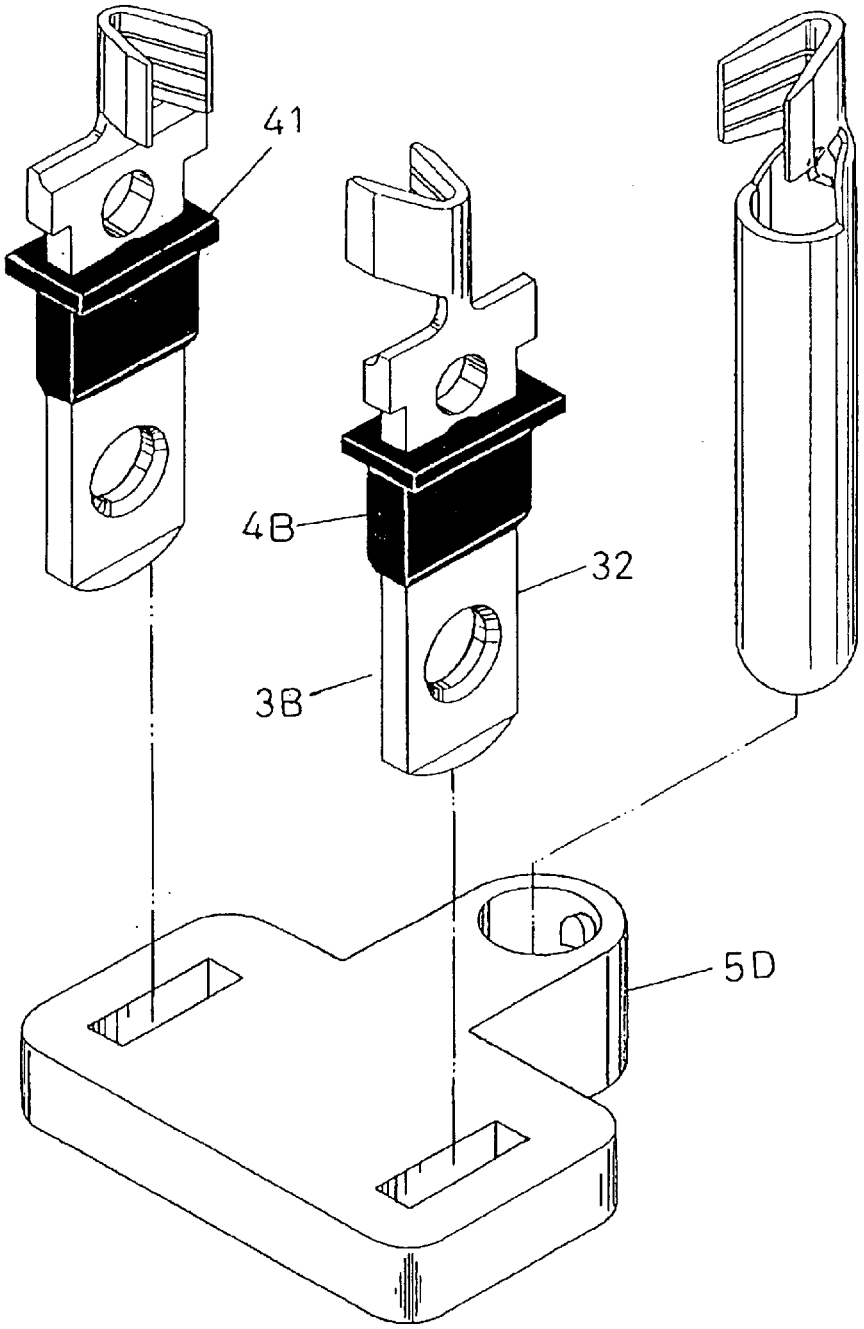
FIG. 22 is an exploded perspective view of a semi-product of another plug made from the plug blade in FIG. 7.
Figure 24:
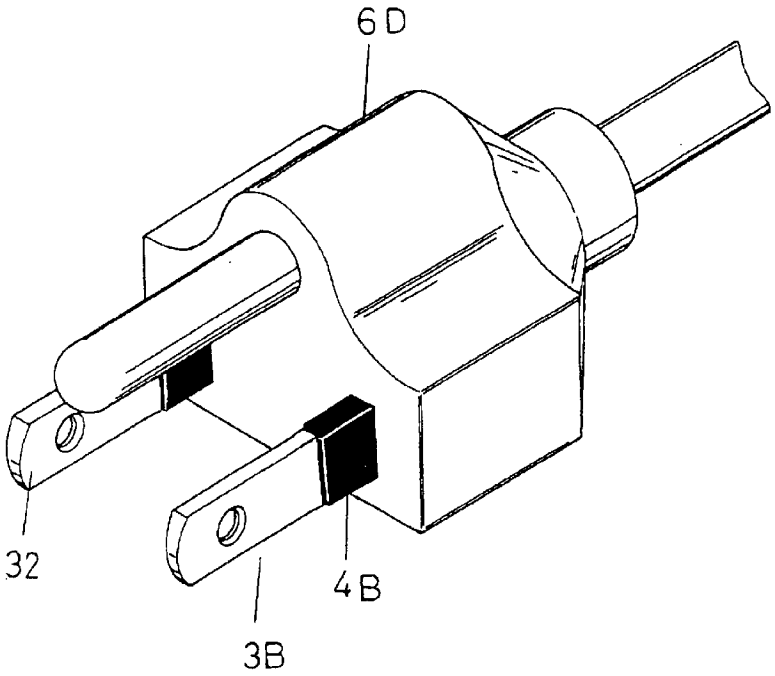
FIG. 24 is a perspective view of a plug made from semi-product of another plug in FIG. 23.
Figure 23:
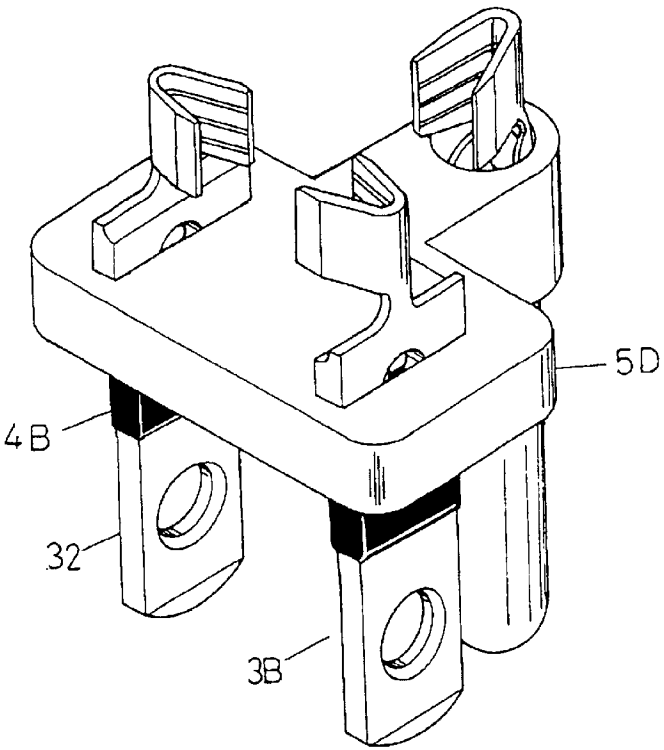
FIG. 23 is a perspective view of the semi-product of another plug in FIG. 22.

FIG. 22 is an exploded perspective view of a semi-product of other plug made from the plug blade in FIG. 7. FIG. 23 is a perspective view of the semi-product of another plug in FIG. 22. FIG. 24 is a perspective view of a plug made from semi-product of another plug in FIG. 23. An insulating layer 4B is firstly formed on the respective plug blade 3B. After coupling an end of a wire (not show) to the respective plug blade 3B, the respective plug blade 3B is mounted on and thus positioned by an inner frame 5D for subsequent formation of a housing 6D by means of injection molding. Thus, a plug with three plug blades 3B is provided.

Figure 30:
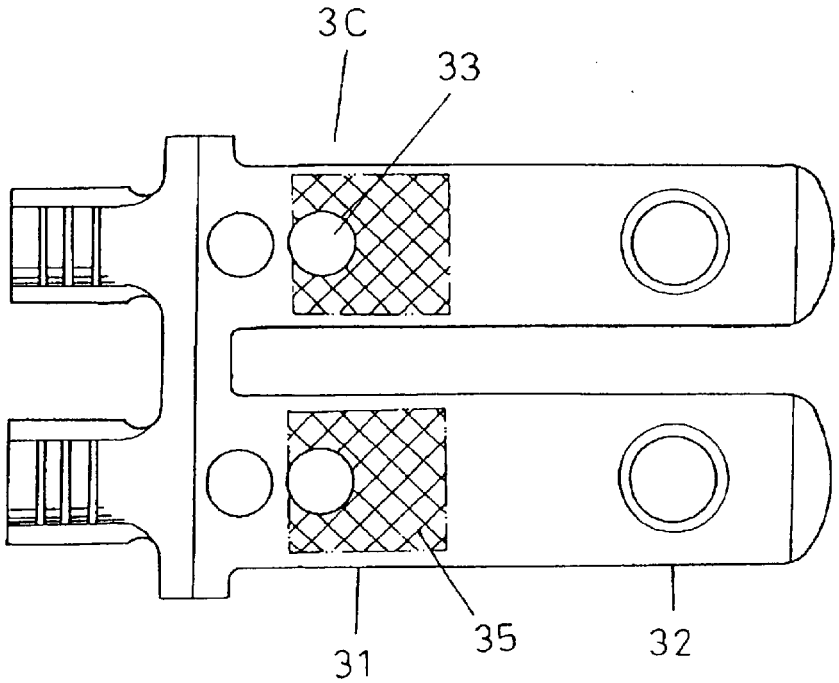
FIG. 30 is a sectional view of a row of plug blades in accordance with a fourth embodiment of the present invention.
Figure 31:
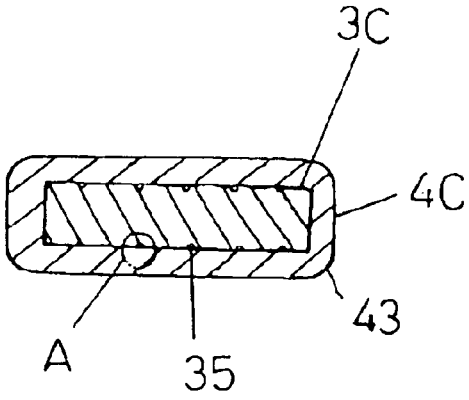
FIG. 31 is a sectional view of the respective plug blade in FIG. 30.
Figure 32:
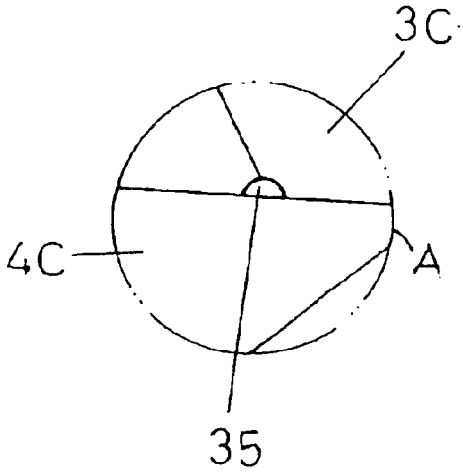
FIG. 32 is and view of a circled portion in FIG. 31.

FIG. 30 is a sectional view of a row of plug blades in accordance with a fourth embodiment of the present invention. FIG. 31 is a sectional view of the respective plug blade in FIG. 30. FIG. 32 is an enlarged view of a circled portion in FIG. 31. An embossed section 35 is preferably formed on at least one of the two faces of the rear section 31 of the respective plug blade (now designated by 3C). The embossed section 35 improves the bonding strength between the respective face of the respective plug blade 3C and the insulating layer (now designated by 4C) on the respective plug blade 3C, further avoiding entrance of moisture into an interior of the housing of the final plug.

According to the above description, it is appreciated that the insulating layer 4, 4A, 4B, 4C is firmly bonded with the plug blade 3, 3A, 3B, 3C as the insulating layer 4, 4A, 4B, 4C fills the through-hole 33 of the plug 3, 3A, 3B, 3C. The insulating layer 4, 4A, 4B, 4C made of plastic material provides a so bonding effect with the t-hole 33 of the plug 3, 3A, 3B, 3C. The flange 41, 41A, 41B that abuts ast the inner face of the inner frame 5, 5A, 5B, 5C, 5D, 5E avoids entrance of moisture into an interior of the housing 6, 6A, 6B, 6C, 6D, 6E. The insulating layer 4, 4A, 4B, 4C on the rear section 31 of the plug blade 3, 3A, 3B, 3C reduces the risk of shock resulting from inadvertent touch of the rear section 31 of the plug blade 3, 3A, 3B, 3C by the user.

Although the invention has been explained in relation to its preferred embodiment, it is to be understood that many other possible modifications and variations can be made without departing from the scope of the invention as hereinafter claimed.

What is claimed is:

1. A plug blade comprising a front section and a rear section, the rear section having an embossed section formed in two opposing faces thereof and a through-hole formed in the embossed section and extending from a first face of the two opposing faces to the second opposing face thereof, an insulating layer being formed on the rear section by injection molding and filling the through-hole of the rear section of the plug blade, the insulating layer including a flange formed at a rear end thereof and circumscribing the rear section and having four corners, each of the corners of the flange having an arcuate contour, the flange being adapted to abut against an inner face of an inner frame during a procedure for forming a housing of a plug, thereby preventing moisture from entering an interior of the housing of the plug.

* * * * *